United States Patent [19]

Mattei et al.

[11] Patent Number: 4,583,557

[45] Date of Patent: Apr. 22, 1986

[54] METHOD AND MACHINE FOR THE SIMULTANEOUS MANUFACTURE OF TWO CONTINUOUS STREAMS OF CIGARETTES

[75] Inventors: Riccardo Mattei, Bologna; Bruno Belvederi, S. Martino di Monte San Pietro, both of Italy

[73] Assignee: G.D Societa' per Azioni, Bologna, Italy

[21] Appl. No.: 608,026

[22] Filed: May 7, 1984

[30] Foreign Application Priority Data

May 27, 1983 [IT] Italy ..... 3440 A/83

[51] Int. Cl.[4] ..... A24C 5/18

[52] U.S. Cl. ..... 131/84.1; 131/906

[58] Field of Search ..... 131/84 R, 84 B, 84 C, 131/60, 906, 908, 910, 34, 65

[56] References Cited

U.S. PATENT DOCUMENTS 4,336,812 6/1982 Seragnoli ..... 131/84.1

4,418,705 12/1985 Seragnoli ..... 131/84.1

*Primary Examiner*—V. Millin

*Assistant Examiner*—H. Macey

*Attorney, Agent, or Firm*—Marshall, O'Toole, Gerstein, Murray & Bicknell

[57] ABSTRACT

Method and machine for manufacturing two continuous streams of cigarettes. A continuous strip of paper is cut longitudinally into two strips which are fed through a tobacco loading station and along respective guides for forming respective continuous wrapped cigarette rods. The rods are fed to a crosswise cutting device by means of respective conveyor belts, the drive rollers of which are driven by a single motor through a differential assembly controlled by detecting devices designed to control, directly or indirectly, the tension on the strips and to keep them at the same tension.

16 Claims, 4 Drawing Figures

92
90
93
96
95

59
97
79
82
80
76
73
74
77
75
84
66
85
65
72
70
71
78
81
83
89
87
31
91
86
92
32
88
96
90
93
95
96
94
96
69

60

METHOD AND MACHINE FOR THE SIMULTANEOUS MANUFACTURE OF TWO CONTINUOUS STREAMS OF CIGARETTES

BACKGROUND OF THE INVENTION

The present invention relates to a method enabling the simultaneous manufacture of two continuous streams of cigarettes.

U.S. Pat. No. 4,336,812 filed by the present Applicant relates to a manufacturing machine designed to enable the simultaneous manufacture of two continuous cigarette rods starting from a single strip of paper cut longitudinally into two essentially identical strips. By means of respective conveyor belts arranged side by side and driven by a single drive roller, the said two strips are fed along a top, where the said rods are made, and through a loading station where each strip is loaded with a respective stream of shredded tobacco.

One of the major operational drawbacks on the abovementioned machine lies in the use of the said single drive roller which presupposes the same dynamic behaviour on both conveyor belts. In actual fact, however, this is not so, owing to the fact that two conveyor belts are never exactly the same. It follows, therefore, that, when two theoretically identical belts are set up along identical routes and round a single drive roller, the speed of one may differ from that of the other, especially after a given operating time.

As, on the abovementioned machine, the two strips for making the two rods are formed from the same strip of paper, any difference in travelling speed could result in at least one of the strips being torn if the said difference is not rectified immediately.

SUMMARY OF THE INVENTION

The aim of the present invention is to provide for the simultaneous manufacture of two streams of cigarettes but without the aforementioned drawback.

With this aim in view, the present invention relates to a method enabling the simultaneous manufacture of two continuous streams of cigarettes, characterised by the fact that it comprises stages consisting in:

feeding a strip of paper to a first cutting device;

activating the said first cutting device so as to cut the said strip of paper longitudinally into a first and second strip of paper essentially identical to each other;

feeding the said strips, by means of a respective first and second conveyor belt, through a loading station, where a respective stream of shredded tobacco is fed on to each said strip, and along a top where the respective continuous cigarette rods are formed; the said conveyor belts being provided with respective independent drive rollers;

feeding the said two rods through a second cutting device designed to cut the said rods crosswise so as to form the said two continuous streams of cigarettes;

controlling continually, via measuring means, either directly or indirectly, the tension on the said two strips, and applying output signals from the said measuring means for controlling the surface speed of at least one of the said two drive rollers so as to maintain the tension on the said two strips constantly equal.

The present invention also relates to a machine for the simultaneous manufacture of two continuous streams of cigarettes according to the abovementioned method.

The present invention relates to a machine for the simultaneous manufacture of two continuous streams of cigarettes, the said machine comprising a device for feeding a continuous strip of paper, a first cutting device designed to cut the said strip of paper longitudinally into a first and second strip of paper essentially identical to each other, a top, a first and second conveyor belt arranged side by side, running partially over the said top and designed to exert traction on the said strips so as to feed them along the top and through a loading station where each said strip is loaded, in use, with a respective stream of shredded tobacco, means for forming continuous cigarette rods, arranged on the said top and designed to cooperate with the said two strips for forming two continuous rods simultaneously, and a second cutting device arranged downstream from the said top and designed to cut the said two rods to form the said two streams of cigarettes, characterised by the fact that the said two conveyor belts are driven by respective drive rollers and measuring means are provided for detecting the tension on the said two strips; at least one of the said drive rollers being provided with drive means controlled by the said measuring means so as to maintain the tension on the said two strips constantly equal.

BRIEF DESCRIPTION OF THE DRAWINGS

Further characteristics and advantages of the present invention will now be described with reference to the attached drawings showing a number of non-limiting arrangements and in which.

DETAILED DESCRIPTION OF THE INVENTION

Figure 1:
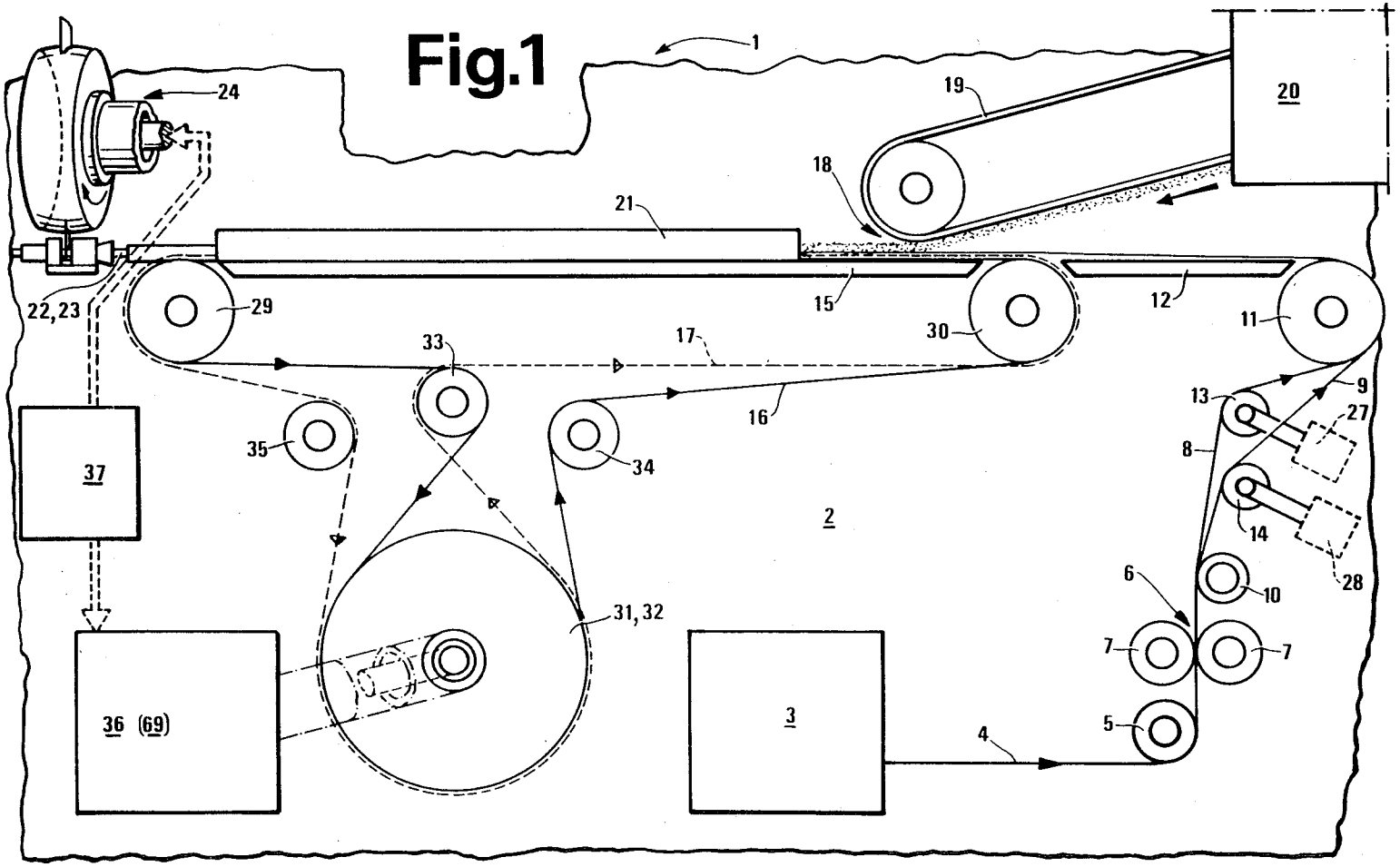
FIG. 1 shows a part view of a cigarette manufacturing machine according to the present invention.

Number 1 in FIG. 1 indicates a cigarette manufacturing machine comprising a bed (2) supporting a device (3) for feeding a continuous strip (4) of cigarette paper. In more detail, strip 4 is twice the width of strips normally used for making continuous cigarette rods on single-rod manufacturing machines.

When it comes out of device 3, strip 4 runs round a guide roller (5) and then through a first cutting device (6) comprising two disc cutters (7) arranged tangentially contacting each other and designed to cut strip 4 along its longitudinal axis into two strips (8, 9) essentially identical to each other.

When they come out of cutting device 6, strips 8 and 9 run round a transmission roller (10) and then round a further transmission roller (11) which guides them over an essentially horizontal top (12) resting in a fixed position on bed 2.

Between rollers 10 and 11, provision is made for two tensioning rollers (13, 14). For the sake of clarity, the routing of strips 8 and 9 in FIG. 1 is offset at the contact point with rollers 13 and 14. Under real operating conditions, strips 8 and 9 travel side by side along identical routes between rollers 10 and 11.

Downstream from top 12, in the travelling direction of strips 8 and 9, provision is made for a second horizontal top (15) lying essentially in the same plane as top 12 and supporting the top branches of two conveyor belts (16, 17) arranged side by side and, for the sake of clarity, illustrated in FIG. 1 by a continuous line (16) and a dotted line (17).

As they move along top 15, strips 8 and 9 pass through a loading station (18) where each of strips 8 and 9 is loaded with a continuous stream of shredded tobacco from a suction type conveyor belt (19) coming out of a known type of feeding unit (20).

Downstream from loading station 18, strips 8 and 9 engage with means for forming continuous cigarette rods, the said means consisting of respective guides (21) having a curved section with a gradually decreasing curve radius and terminating, in known manner, in an essentially cylindrical end section.

In this way, strips 8 and 9 are forced to wrap round the relative streams of tobacco in known manner so as to form two continuous cigarette rods numbered 22 and 23 respectively.

As they come off top 15, the two rods (22, 23) are fed through a second cutting device (24) of known type which cuts the said two rods simultaneously into two continuous streams of cigarettes (25, 26) the speeds of which are exactly the same as strips 8 and 9 and are detected in continuous manner by measuring means comprising respective detecting devices 27 and 28.

Figure 2:
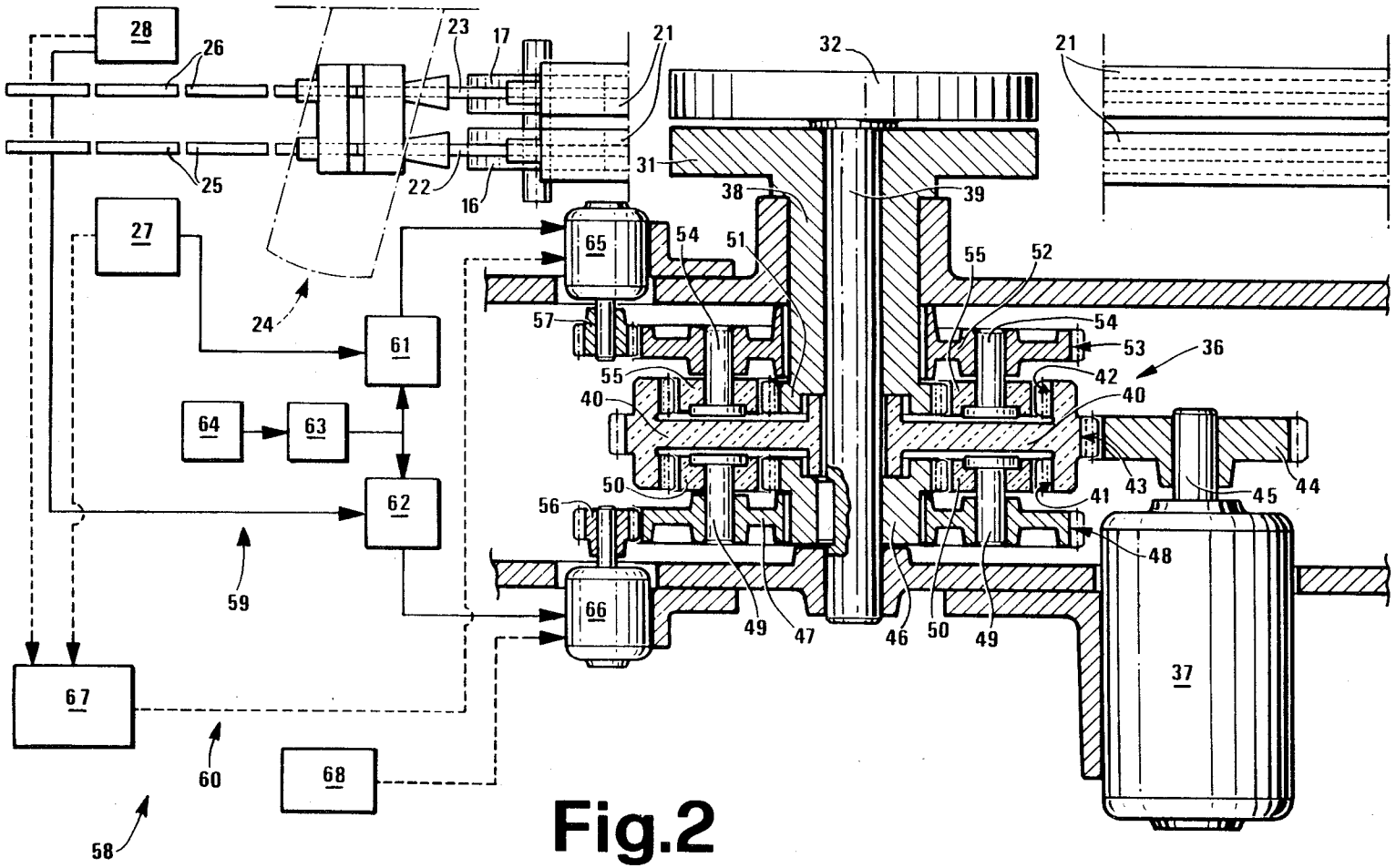
FIG. 2 shows a part section, part block view of a first preferred arrangement of a detail in FIG. 1.

As shown in FIG. 1, both belts 16 and 17 form loops of equal length but which only coincide partially for facilitating maintenance. In more detail, both belts 16 and 17 loop round common transmission rollers (29, 30) at opposite ends of top 15 and respective drive rollers (31, 32) (FIG. 2). Between rollers 29 and 31 and between the latter and roller 30, belt 16 winds clockwise round transmission roller 33 and round tensioning roller 34 respectively. On the other hand, between rollers 29 and 32 and between the latter and roller 30, belt 17 winds clockwise round tensioning roller 35 and transmission roller 33 respectively.

Rollers 31 and 32 are turned by drive means comprising a differential assembly (36) connected to a single motor (37) which also drives cutting device 24;

As shown in FIG. 2, differential assembly 36 comprises a hollow shaft (38) supporting roller 31, fitted on one end, and housing, in rotary manner, shaft 39 coaxial with shaft 38 and projecting from it for fitting on roller 32. At the other end, shaft 39 projects from shaft 38 for idly supporting disc 40 on the outer contour of which are formed two inner rings (41, 42), on opposite faces of disc 40, and external teeth (43) meshing with gear 44 fitted on to output shaft 45 of motor 37.

Shaft 39 is also fitted with a sun gear (46) supporting in rotary manner a train carrier (47) coaxial with the said gear and provided with external peripheral teeth (48). Train carrier 47 supports two peripheral axial pins (49) arranged diametrically opposite and each fitted in rotary manner with a planet gear (50) between sun gear 46 and ring 41.

On the end facing disc 40, shaft 38 supports a sun gear (51), turning with shaft 38 itself, and an idle train carrier (52) coaxial with gear 51 and provided with external peripheral teeth (53) coaxial and essentially identical with teeth 48. Train carrier 52 supports two peripheral axial pins (54) arranged diametrically opposite and each fitted in rotary manner with a planet gear (55) between sun gear 51 and ring 42.

Teeth 48 and 53 mesh with respective gears 56 and 57 which constitute the outputs of a control assembly (58) the inputs of which consist of detecting devices 27 and 28. Each of the latter has two identical outputs connected respectively to two alternative, separate, independent circuits (59, 60).

Circuit 59 comprises two comparing means (61, 62), a first input of which is connected to the output of a means (63) for emitting a reference signal which may be modified as required via varying means 64, and a second input of which is connected to the output of respective detector 27, 28. Comparators 61 and 62 are designed to emit an output signal for controlling respective actuating means consisting of motors 65 and 66 which are preferably step-by-step types and the respective output shafts of which are fitted with gears 57 and 56. Circuit 60 comprises a comparing means (67) the inputs of which are connected to the outputs of detectors 27 and 28 and the output of which is connected to either one of motors 65 and 66. In the example shown, the output of comparator 67 controls motor 65. In use, the respective speeds of cigarettes 25 and 26 coming off cutting device 24 are measured by detecting devices 27 and 28 the output signals of which, when using circuit 59 (the connecting lines of which are shown by a continuous line in FIG. 2) are confronted by respective comparators 61 and 62 with the reference signal supplied by emitter 63 and relative to the speed the cigarettes are required to travel at.

In the event of a discrepancy between the said reference signal and either or both of the signals emitted by detectors 27 and 28, comparator 61 and/or 62 detecting the said discrepancy emits a corresponding error signal which activates the respective motor (65, 66) so as to rectify it. If, for example, detectors 27 and 28 find that cigarettes 25 are travelling at the right speed whereas cigarettes 26 are travelling at less than the required speed, motor 66 is activated so as to accelerate roller 32 and bring cigarettes 26 up to the right speed by means of differential assembly 36 operation of which is clearly understandable and needs no explaining.

In connection with the above statement, it should be pointed out that controlling the respective speeds of cigarette streams 25 and 26 or of any similar parameter, such as the length of the cigarettes being manufactured, amounts to controlling the travelling speed of strips 8 and 9 which, in turn, amounts to controlling the respective tension of strips 8 and 9 in that any variation in either or both of the said streams in relation to a preset value corresponds to a variation in the tension on the corresponding strip 8 and 9.

The accuracy with which speed and tension are matched is shown in the variation illustrated by the dotted line in FIG. 1 whereby, instead of being controlled indirectly by controlling the respective speed of cigarette streams 25 and 26, the respective tension on strips 8 and 9 may be controlled directly using detecting devices 27 and 28 connected to tensioning rollers 13 and 14.

Besides the main function of maintaining strips 8 and 9 at the same preset tension at all times, thus removing any danger of tearing immediately downstream from cutting device 6, circuit 59 also provides for optimizing output on machine 1.

In view of the constant speed imposed by motor 37 on cutting device 24, maintaining cigarette streams 25 and 26 at the same preset reference speed at all times means the length of cigarettes 25 and 26 can also be maintained constantly at a preset value and varied as required by means of variator 64 which provides for continuous, troublefree length adjustment.

If circuit 60 (the connecting lines of which are shown by a dotted line in FIG. 2) is used in place of circuit 59, a first of the signals emitted by detectors 27 ans 28 is taken as a reference signal for controlling continuously the second and keeping it equal to the first at all times by controlling, with the output signal from comparator 67, whichever one of motors 65 or 66 is capable of varying the said second signal, while the other motor remains disabled. In the example shown, the speed of roller 32 is regulated by motor 66 so as to keep the travelling speed of strip 9 constantly equal to that of strip 8 used as a reference. Circuit 60 therefore provides for maintaining strips 8 and 9 at the same speed and, consequently, the same tension at all times, thus removing any danger of tearing immediately downstream from cutting device 6, but it does not provide for controlling either the reference speed of strip 8 or 9 or length.

If required, this drawback may be eliminated by fitting machine 1 with manually operated control means (68) (the connecting line of which to motor 66 is shown by a dotted line in FIG. 2) consisting of a pulse emitting means the frequency of which may be regulated manually.

Obviously, if circuit 60 is used constantly and the possibility of controlling reference speed and length is not required, the part of differential assembly 36 designed for controlling the speed of strip 8 or 9 used as a reference may be eliminated.

Figures 3, 4:
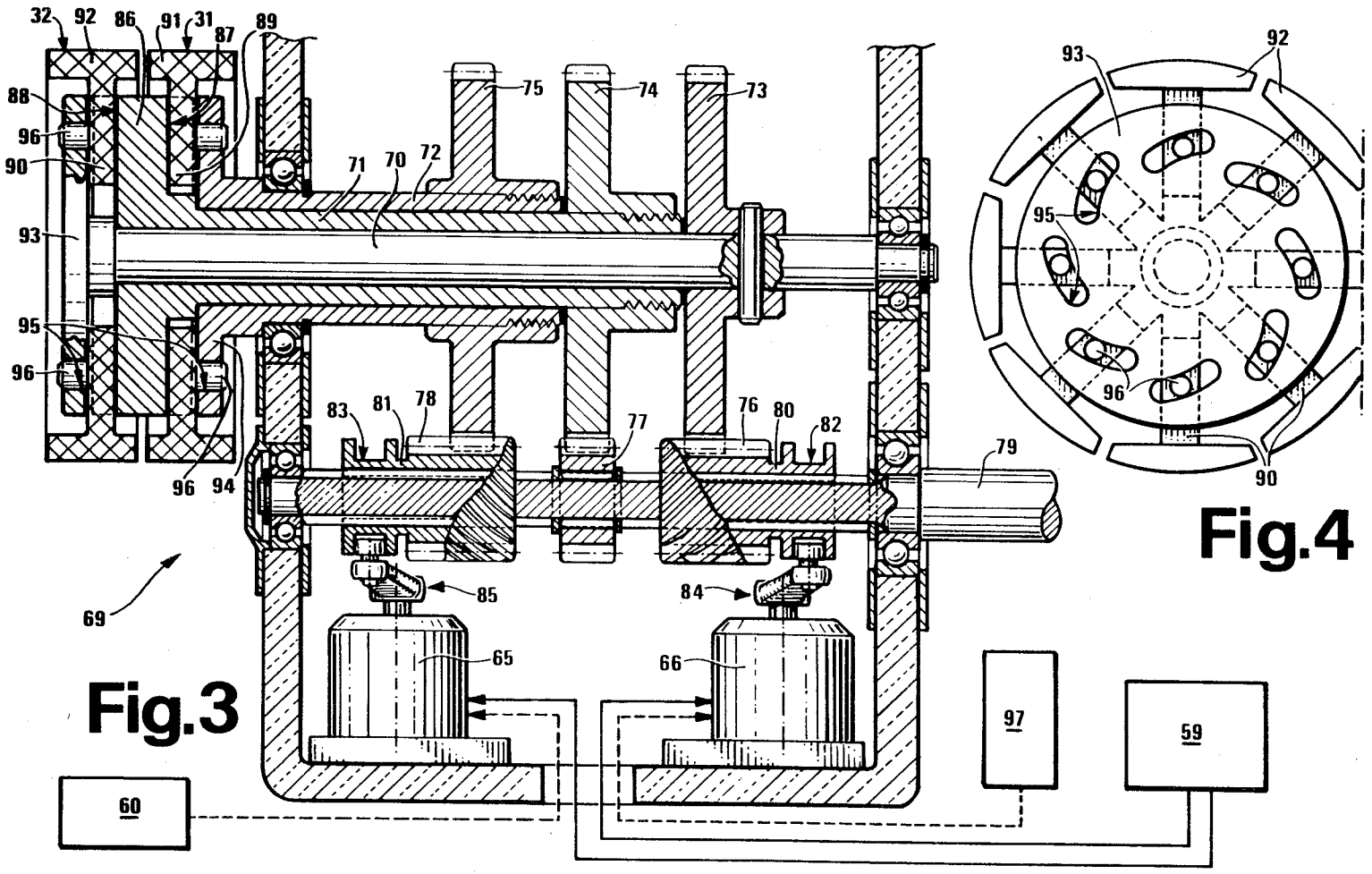
FIG. 3 shows a part section, part block view of a second preferred arrangement of a detail in FIG. 1.
FIG. 4 shows a front view of a detail in FIG. 3.

According to the variation shown in FIG. 3, differential assembly 36 in FIG. 2 is replaced by differential assembly 69 comprising a centre shaft (70) the opposite ends of which project from the ends of a first tubular shaft (71) fitted idly on to it. In turn, the opposite ends of tubular shaft 71 project from the ends of a second tubular shaft (72) fitted idly on to shaft 71.

The ends of shafts 70, 71 and 72 are fitted on the same side with respective helical gears 73, 74 and 75, all having the same pitch diameter and meshing with respective helical gears 76, 77 and 78. The latter are angularly connected to a single shaft (79) parallel to shaft 70 and connected (in a manner not shown) to the said motor 37. In more detail, gear 77 is fitted on to shaft 79 while gears 76 and 78 are fitted on to respective couplings 80 and 81 connected to shaft 79 in sliding and angularly fixed manner by means of respective splined couplings. Couplings 80 and 81 have respective annular grooves 82 and 83 engaged by respective tappets assembled on the ends of respective crankshafts 84 and 85 driven respectively by motors 66 and 65.

The end of coupling 71, opposite the end connected to helical gear 74, is fitted with a disc (86) on the opposite axial surfaces of which are formed two sets of radial grooves (87, 88) fitted inside in sliding manner with respective rods (89, 90) connected at the outer ends to respective sectors (91, 92) constituting the two rollers (31, 32) respectively.

The ends of shafts 70 and 72, opposite the ends connected to gears 73 and 75, are connected integral with respective discs 93 and 94 arranged respectively facing the ends of disc 86 with grooves 88 and 87.

As shown, particularly in FIG. 4, each of discs 93 and 94, of which only disc 93 is shown, is provided with a number of spiral-shaped slots (95) each of which is fitted inside, in crosswise sliding manner, with a respective pin (96) parallel to the axis of shaft 70. Each of pins 96 engaged inside a respective slot 95 on disc 93 is integral with a mid point on a respective rod 90, whereas each of pins 96 engaged inside a respective slot 95 on disc 94 is integral with a mid point on a respective rod 89.

Unlike differential assembly 36 which varies the speed of rollers 31 and 32, differential assembly 69 varies their diameter and, consequently, their surface speed by varying the angle of discs 93 and 94 in relation to disc 86 and, consequently, the position of pins 96 inside respective slots 95, thus causing sectors 91 and 92 to move radially one way or the other. This is achieved using helical gears 73, 76 and 75, 78 the two-by-two connection of which results, in each pair, in a variation of the rotation speed of the first of the two gears in response to axial displacement of the other caused by activating motor 66 or 65 connected to it.

Motors 65 and 66 of differential assembly 69 are controlled by circuit 59 or 60 already described in connection with FIG. 2.

Obviously, in the case of differential assembly 69 also, all the parts designed for controlling whichever of rollers 31 or 32 is used as a reference may be dispensed with if circuit 60 is employed.

The reference roller (32 in the example shown) may be provided with manually operated adjustment varying means (97) (the connecting line of which is shown by the dotted line) consisting, for example, of a pulse emitting means connected to the input of motor 66.

We claim:

1. Method for the simultaneous manufacture of two continuous streams of cigarettes (25, 26), characterized by the fact that it comprises the steps of:

feeding a strip of paper (4) to a first cutting device (6);

activating the said first cutting device (6) so as to cut the said strip of paper (4) longitudinally into first (8) and second (9) strips of paper essentially identical to each other;

feeding the said strips (8, 9), by means of respective first (16) and second (17) conveyor belts, through a loading station (18), where a respective stream of shredded tobacco is fed on to each said strip (8, 9), and along a top (15) where each said strip is wrapped around a respective stream of shredded tobacco to form a respective continuous cigarette rod; the said conveyor belts (16, 17) being provided with respective independent drive rollers (31, 32);

feeding the said two rods (22, 23) through a second cutting device (24) designed to cut the said rods (22, 23) crosswise so as to form the said two continuous streams of cigarettes (25, 26);

controlling continually, via measuring means (27, 28), either directly or indirectly, the tension on the said two strips (8, 9), and applying output signals from the said measuring means (27, 28) for controlling the surface speed of at least one of the said two drive rollers (31, 32) so as to maintain the tension on the said two strips (8, 9) constantly equal.

2. Method according to claim 1, characterised by the fact that the said two drive rollers (31, 32) and the said second cutting device (24) are driven by a single motor (37); the latter being connected to the said two rollers (31, 32) via a differential assembly (36 or 69) controlled by the said measuring means (27, 28).

3. Method according to claim 2, characterised by the fact that the said differential assembly (36) is designed to control the speed of at least one of the said two drive rollers (31, 32).

4. Method according to claim 2, characterised by the fact that the said two rollers (31, 32) are each defined by radially mobile sectors (91, 92); the said differential assembly (69) being designed to vary the diameter of at least one of the said drive rollers (31, 32).

5. Method according to claim 2, characterised by the fact that the said output signals from the said measuring means (27, 28) are each compared with the same reference signal by a comparator (61, 62); any error signals emitted by the said comparator (61, 62) controlling two motors (65, 66) each connected to a respective said drive roller (31, 32) via the said differential assembly (36 or 69).

6. Method according to claim 5, characterised by the fact that it comprises an accessory stage consisting in varying the length of the said cigarettes (25, 26); the said length variation being achieved by varying the said reference signal.

7. Method according to claim 2, characterised by the fact that the output signals from a first of the said measuring means (27, 28) are compared, in a comparator (67), with the output signals from the second of the said measuring means (27, 28) used as a reference signal; the output signals from the said comparator (67) controlling a motor (65 or 66) connected to a respective said drive roller (31 or 32) via the said differential assembly (36 or 69); and the said drive roller (31 or 32) being connected to whichever of the said two strips (8 or 9) is controlled by the said first measuring means (27 or 28).

8. Method according to claim 7, characterised by the fact that manual operating means (68 or 97) are provided for controlling whichever of the said two drive rollers (31 or 32) is connected to the strip (8 or 9) controlled by the said first measuring means (27 or 28).

9. Machine for the simultaneous manufacture of two continuous streams of cigarettes (25, 26) as per the method claimed in claim 1, the said machine comprising a device (3) having means for feeding a continuous strip of paper (4), a first cutting device (6) having means to cut the said strip of paper (4) longitudinally into a first (8) and second (9) strip of paper essentially identical to each other, a top (15), a first (16) and second (17) conveyor belt arranged side by side, running partially over the said top (15) and having means to exert traction on the said strips (8, 9) so as to feed them along the top (15) and through a loading station (18) where each said strip (8, 9) is loaded, in use, with a respective stream of shredded tobacco, means (21) for forming continuous cigarette rods (22, 23), arranged on the said top (15) and designed to cooperate with the said two strips (8, 9) for forming two continuous rods (22, 23) simultaneously, and a second cutting device (24) arranged downstream from the said top (15) and having means to cut the said two rods (22, 23) to form the said two streams of cigarettes (25, 26), characterised by the fact that the said two conveyor belts (16, 17) are driven by respective drive rollers (31, 32) and measuring means (27, 28) are provided for detecting, directly or indirectly, the tension on the said two strips (8, 9); at least one of the said drive rollers (31, 32) being provided with drive means (37, 36 or 69) controlled by the said measuring means (27, 28) so as to maintain the tension on the said two strips (8, 9) constantly equal.

10. Machine according to claim 9, characterised by the fact that the said drive means comprise a single motor (37) and a differential assembly (36 or 69) between the said motor (37) and the said drive rollers (31, 32); the said motor (37) also driving the said second cutting device (24), and the said differential assembly (36 or 69) comprising an input connected to the said motor (37), two outputs connected respectively to the said two drive rollers (31, 32) and a further two inputs connected to respective actuating means (65, 66) at least one of which is controlled by the said measuring means (27, 28).

11. Machine according to claim 10, characterised by the fact that the said two outputs consist of two shafts (38, 39 or 72, 70) integral with the said drive rollers (31, 32).

12. Machine according to claim 10, characterised by the fact that the said two drive rollers (31, 32) are associated within a common drive disc (86) connected directly to the said motor (37), each drive roller (31, 32) comprising a plurality of sectors (91, 92), adapted to move radially in relation to the said disc (86), and a shaft (72, 70), means for associating said sectors, said drive disc and said shaft, whereby rotation of said shaft relative to said drive disc controls the radial position of the said sectors (91, 92) in relation to the said disc (86); each said shaft (72, 70) constituting one of the said outputs.

13. Machine according to claim 10, characterised by the fact that the said measuring means comprise two means (27, 28) for emitting signals depending on the tension of the said two strips (8, 9), a reference signal emitter (63) and comparing means (61, 62 or 67) for comparing each of the said tension signals with the said reference signal; the said actuating means comprising two motors (65, 66) controlled by the said comparing means (61, 62 or 67) and each connected to one of the said further inputs.

14. Machine according to claim 13, characterised by the fact that it comprises means (64 or 97) for varying the said reference signal.

15. Machine according to claim 10, characterised by the fact that the said measuring means comprise first (27) and second (28) means for emitting signals depending respectively on the tension of the said two strips (8, 9) and comparing means (67) for comparing the signals from the said first emitting means (27), taken as a reference signal, with the signals from the said second emitting means (28); the said actuating means comprising a motor (66) controlled by the said comparing means (67) and connected to whichever of the said two further inputs is connected to the strip (9) controlled by the said second emitting means (28).

16. Machine according to claim 15, characterised by the fact that the said actuating means also comprise manual operating means (68 or 97) connected to whichever of the said two further inputs is connected to the strip (9) controlled by the said second emitting means (28).

* * * * *